US005135159A

United States Patent [19]

Giblin et al.

[11] Patent Number: 5,135,159

[45] Date of Patent: Aug. 4, 1992

[54] FOLDING POUR SPOUT

[75] Inventors: Edward J. Giblin, Pompton Lakes; James M. Gleason, Basking Ridge; John A. Hockey, Ridgewood, all of N.J.

[73] Assignee: Lever Brothers COmpany, Division of Conopco, Inc., New York, N.Y.

[21] Appl. No.: 387,465

[22] Filed: Jul. 28, 1989

[51] Int. Cl.[5] ..... B65D 5/74

[52] U.S. Cl. ..... 229/123.1; 229/125.04; 229/125.09; 229/215

[58] Field of Search ..... 206/621.4, 621.3; 229/123.1, 123.2, 132.3, 125.05, 125.08, 125.15, 125.32, 125.04, 125.09; 222/527, 528, 533–535, 556, 531, 532

[56] References Cited

U.S. PATENT DOCUMENTS

| | | | |
|---|---|---|---|
| 2,007,553 | 7/1935 | Vincent | 229/125.04 |
| 2,701,678 | 2/1955 | Read | 206/621.3 |
| 2,757,830 | 8/1956 | Hansen | 222/528 |
| 3,055,571 | 9/1962 | Hassler | 229/123.2 |
| 3,484,034 | 12/1969 | Sternau | 229/125.04 |
| 3,487,985 | 1/1970 | Spangler | 229/125.04 |
| 3,565,300 | 2/1971 | Dietz | 222/528 |
| 3,734,361 | 5/1973 | Brucker et al. | 222/556 |
| 3,989,171 | 11/1976 | Arneson | 229/123.1 |
| 4,111,351 | 9/1978 | MacKiernan | 222/535 |
| 4,150,778 | 4/1979 | Engdahl, Jr. | 222/528 |
| 4,192,440 | 3/1980 | Smith | 229/125.04 |
| 4,953,781 | 9/1990 | Bryan | 206/621.4 |

*Primary Examiner*—Gary E. Elkins
*Attorney, Agent, or Firm*—Gerard J. McGowan, Jr.

[57] ABSTRACT

A folding pour spout, particularly, for detergent cartons. The spout is formed from a spout blank preferably comprising a single thin sheet of plastic. The spout blank includes a first spout-forming panel having a pull tab, a second spout-forming panel including notches and a panel for attachment to a carton. The reduced thickness of the spout blank facilitates manufacturing of the carton.

1 Claim, 6 Drawing Sheets

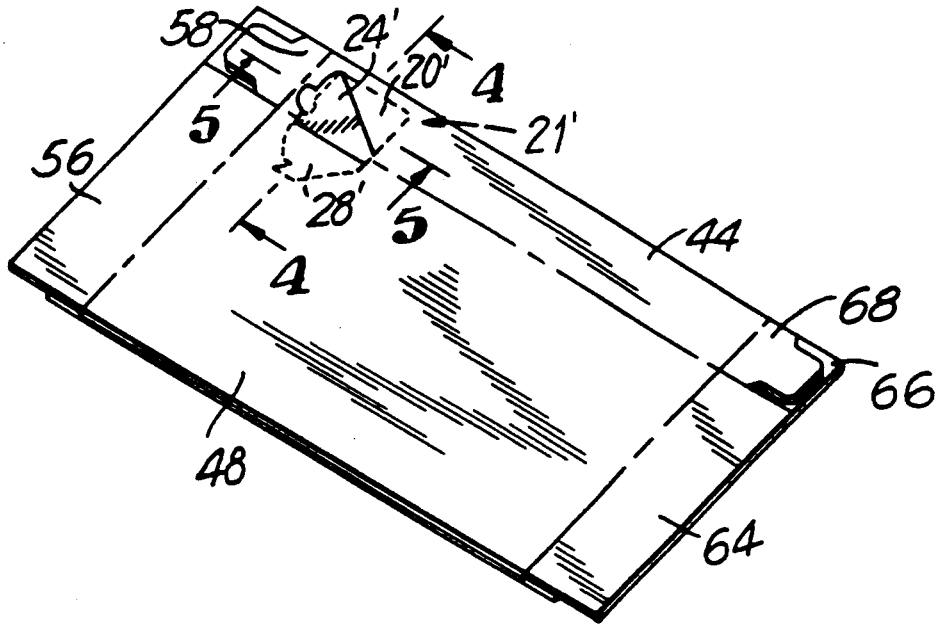
FIG. 3
FIG. 4
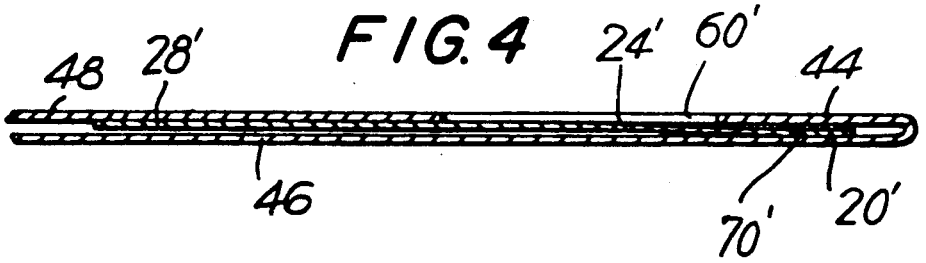
FIG. 5
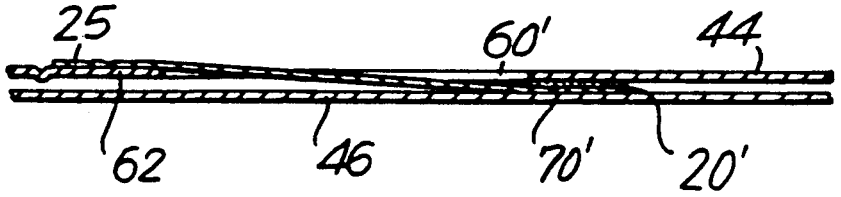

FIG. 9
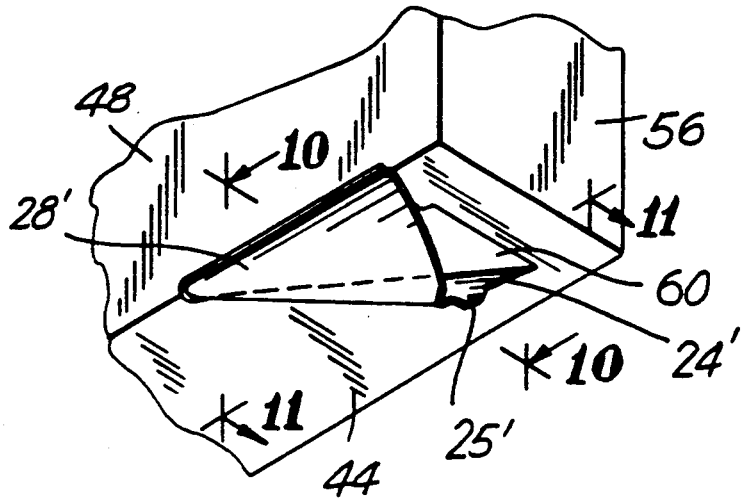
FIG. 10
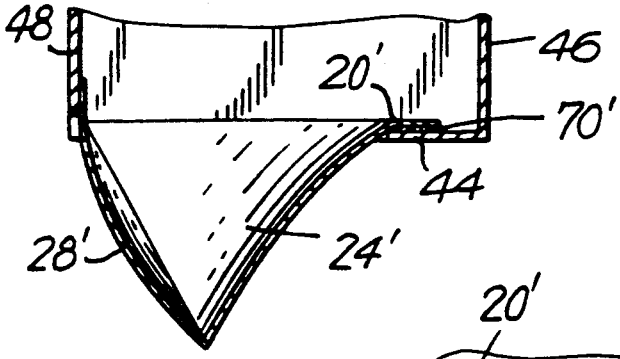
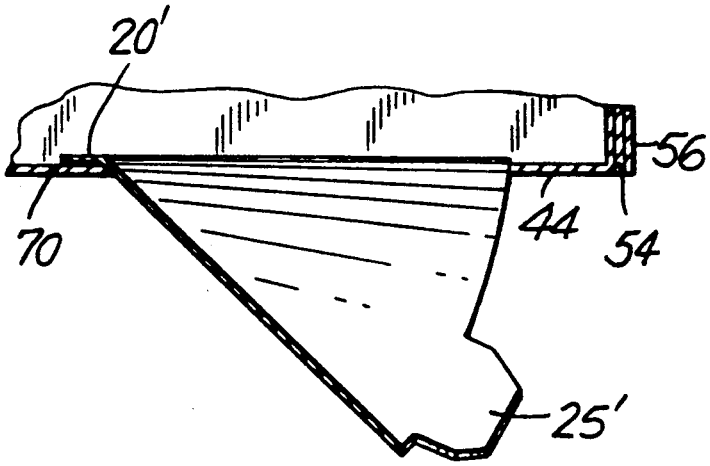
FIG. 11

FOLDING POUR SPOUT

BACKGROUND OF THE INVENTION

Powdered laundry detergents have typically been provided in cartons fabricated from paperboard. While cartons have many acceptable properties, difficulties have sometimes been encountered in pouring product therefrom. Cartons have often been provided with die cut perforations in the paperboard along which the consumer makes an opening in the carton. Frequently, however, consumers find it difficult to rupture the perforations so as to open the carton. Moreover, once an opening in the carton has been made it is often difficult to control the product during pouring due to the irregular shape of the pouring aperture created by the consumer. Furthermore, openings formed in the paperboard are usually not reclosable. As a result, a tendency exists for the product to spill undesirably from the carton if tipped, and especially during transport. Moreover, products which are sensitive to moisture pick-up tend to cake because of the exposed opening.

Recently, attempts have been made to solve the aforementioned problems through the use of plastic fitments. Plastic fitments have been proposed which can be adhesively attached to the carton. It is generally desirable for detergent manufacturers that the fitment be affixed during or prior to the period when the paperboard carton is in a flat, tubular form prior to erection of the carton. However, according to Gunn U.S. Pat. No. 4,732,315, when a thin, plastic fitment is affixed to the carton in its flat, tubular form problems may arise during stacking of the tubes due to an imbalance in the otherwise flat cartons caused by the extra thickness of the fitment. Gunn discloses a plastic closure device having an aperture configured in a pentagonal, "home plate" shape said to have rounded corners, which is balanced by means integral with the carton. For instance, the means may comprise score lines which are thickened to offset the extra thickness of the fitment.

Previous attempts at developing carton closures have included use of thin folded strips of material. For example, Vincent U.S. Pat. No. 2,007,553 is directed to a device which may be used with collapsible container blanks to permit their shipment in collapsed form when empty and which is adapted to form in the erected carton a closure in the closed position and a pouring spout in the open position. The carton has a wall severed to form an angular opening, such as a triangular opening, and is fitted with a spout-forming closure blank hinged to the wall of the carton, preferably by a flap formed during the severance. The closure blank is formed of relatively stiff material such as that from which the carton is formed and comprises a cover position and a wing position separated by a fold line preferably made by scoring. Preferably, the cover and wing positions are generally in the shape of a sector of a circle. A slot in the carton wall receives the upper edge of the wing portion. When the closure is in the closed position, a sticker may be posted over the closure to ensure a tight seal. When discharge of the contents of the carton is desired, the sticker or seal is broken and the closure is swung outward to form a trough-shaped spout.

Dietz et al. U.S. Pat. No. 3,565,300 discloses a carton which includes a V-shaped retractable pouring spout. The spout comprises a spout blank which has two positions separated by a fold line. The carton includes an aperture and a flap which is connected to the carton along one of its borders and which is formed in the course of making the aperture. One of the portions of the spout blank includes prongs which attach to the flap so that in the open position one portion of the spout blank rests on the flap. The other portion of the spout slides along one of the sides of the aperture as the spout is brought from the open to the closed position and is provided with a stop to limit the spout's outward movement and lugs at each end for retaining the spout in the open and closed positions. The Dietz et al. spout blank can be formed of materials such as rigid or semi-rigid aluminum as well as plastic or paperboard.

Harrington U.S. Pat. No. 1,464,073 discloses a salt-pouring spout. The spout blank comprises two spout-forming sections separated by a score line, x, and a securing tab or tongue which is to be glued to the inner face of the cap. A stop lug is provided to prevent the spout from swinging out too far.

Read U.S. Pat. No. 2,735,605 discloses a carton having a pouring spout. A triangular-shaped opening having a flap attached by one side is provided. A blank, which may be secured to the inner wall of the carton, is integral with a sector-shaped section which is glued to the inner surface of the cut out flap. A fold line separates the section from another substantially sector-shaped section. The spout is opened by pulling outwardly a tab on the flap. The flap and the sector-shaped panels of the blank move outwardly. The upper edge of the second sector-shaped section is received within a notch and the gradual frictional resistance between the upper edge of the section and the bottom of the notch as the pouring spout moves to its fully extended position tends to hold the spout in its outward position.

Arneson U.S. Pat. No. 3,989,171 discloses in FIGS. 9 through 12 a V-shaped spout which emerges from a triangular opening in a carton. As seen in FIG. 11, the spout blank includes a first panel, which is attached to a carton cut out flap, and a second panel, which together with the first panel forms the spout when extended through the triangular aperture. The first panel includes a pull tab. The second panel includes a curved or bowed portion adjacent a stop-forming edge portion. FIG. 4 discloses a spout blank which comprises two side panels including stop means and a middle panel which includes a pull tab. Among the described objects of the Arneson invention are a spout which can be readily incorporated in the carton in collapsed condition. The pouring spout is said to be of the same or similar material as the carton.

Whitney U.S. Pat. No. 830,694 discloses a cover for can heads made of paper or paperboard. The cover is formed of pasteboard or similar material and includes two panels disposed at a 90° angle to each other and which form a spout. One of the panels includes a tongue for opening the can and an extension which is to be fixed to the can opening and which is creased to permit movement of the cover along the creased line. The other spout-forming segment includes a stop to prevent it from being opened too far. A label or other protective part can be pasted over so as to seal the cover.

Zalkind U.S. Pat. No. 1,426,439 discloses a container including a chute for pouring its contents. The chute includes two spout-forming walls, stop means and a pull tab.

Groner U.S. Pat. No. 1,714,363 discloses a dispensing carton for items such as soap. The carton includes an integral v-shaped pouring spout. The spout includes a notch 9 and a tab 13.

Perkins U.S. Pat. No. 2,123,546 discloses a package having a spout with stop lugs, and an adhesive patch for sealing the spout.

SUMMARY OF THE INVENTION

The present invention is a folding v-shaped pour spout having three panels, which is attached to the inside of a carton by one of its panels. The invention is also directed to erected cartons, flattened tubular cartons and carton blanks including the pour spout. The thin, preferably plastic, material from which the spout is formed permits the spout to be affixed to the flattened, two dimensional carton blank without making the carton blank unbalanced, which would otherwise cause the blank or the folded tube into which it is formed to stack unevenly.

The pour spout of the invention includes an attachment panel, a first spout-forming panel contiguous therewith and a second spout-forming panel contiguous to the first spout-forming panel. The first spout-forming panel includes means to assist the consumer in grasping the spout. The second spout-forming panel includes notches to keep it in the open and closed positions, stop means and a curved arc-like portion separating the notches. In a preferred embodiment the notches are supplemented with ridges. In a more preferred embodiment a wall is provided to confine the movement of the second spout-forming panel within the carton to prevent interference with product.

The invention also relates to the process of making a carton having a flat, folding pour spout. The process includes attaching to a panel of a carton blank the attachment panel of a spout blank according to the invention, folding the carton blank into a flat tube, and erecting the carton by positioning the panels so that the main and side panels are exactly opposite each other to form a tube of rectangular cross section and folding inwardly the minor and major flaps thereof.

For a more complete understanding of the above and other features and advantages of the invention, reference should be made to the following detailed description of a preferred embodiment and to the accompanying drawings.

BRIEF DESCRIPTION OF THE DRAWINGS

FIG. 3 is a top perspective view of folded tubular carton blank having a folding pour spout which is the mirror image of that of FIG. 2 attached thereto with portions shown in phantom.

FIG. 4 is a cross section along the lines 4—4 of FIG. 3.

FIG. 5 is a cross section along the lines 5—5 of FIG. 3.

FIG. 9 is a perspective view of an erected carton with the folding pour spout of the invention opened to pouring position.

FIG. 10 is a cross section along the lines 10—10 of FIG. 9.

FIG. 11 is a cross section along the lines 11—11 of FIG. 9.

DETAILED DESCRIPTION OF THE INVENTION

Figure 1:
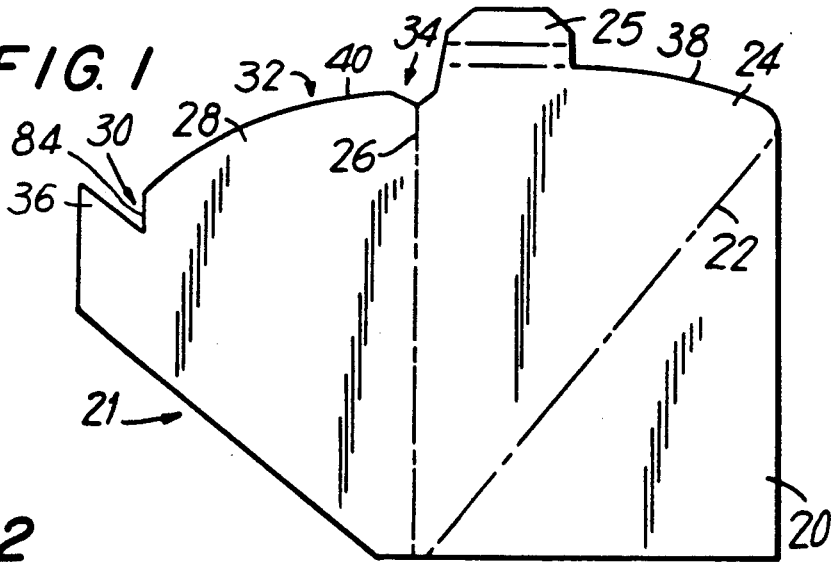
FIG. 1 is a rear elevational view of a folding pour spout in accordance with the present invention.

Referring to FIG. 1, the folding pour spout 21 of the invention initially takes the form of a spout blank which comprises a generally triangular attachment panel 20 contiguous with a first spout-forming panel 24 and separated therefrom by a first fold line 22. First spout-forming panel generally resembles a sector of a circle. The top of first spout-forming panel 24 includes a pull tab 25 projecting therefrom and an arc-like section 38 adjacent to the pull tab. Also contiguous with first spout-forming panel 24 is second spout-forming panel 28, which is separated from first spout-forming panel 24 by second fold line 26. Like first spout-forming panel 24, second spout-forming panel 28 is generally sector-shaped. The first and second spout-forming panels are similarly oriented with their narrow aspects at the bottom and their wider aspects at the top. Second spout-forming panel 28 includes at its upper end stop means 36 projecting therefrom, a notch 30, and an arc-like section 40. Notch 34 is formed between second spout-forming panel 28 and first spout-forming panel 24.

The two fold lines of the spout blank preferably form an angle of less than 90°, more preferably less than about 60°, and still preferably 45° or smaller.

The spout blank is a flat, single sheet of thin plastic such as PETG (glycol-modified polyethylene terephthalate) or PET (polyethylene terephthalate). It can be used in the configuration shown in FIG. 1, or in other variations, such as the mirror image of the spout of FIG. 1.

Figure 2:
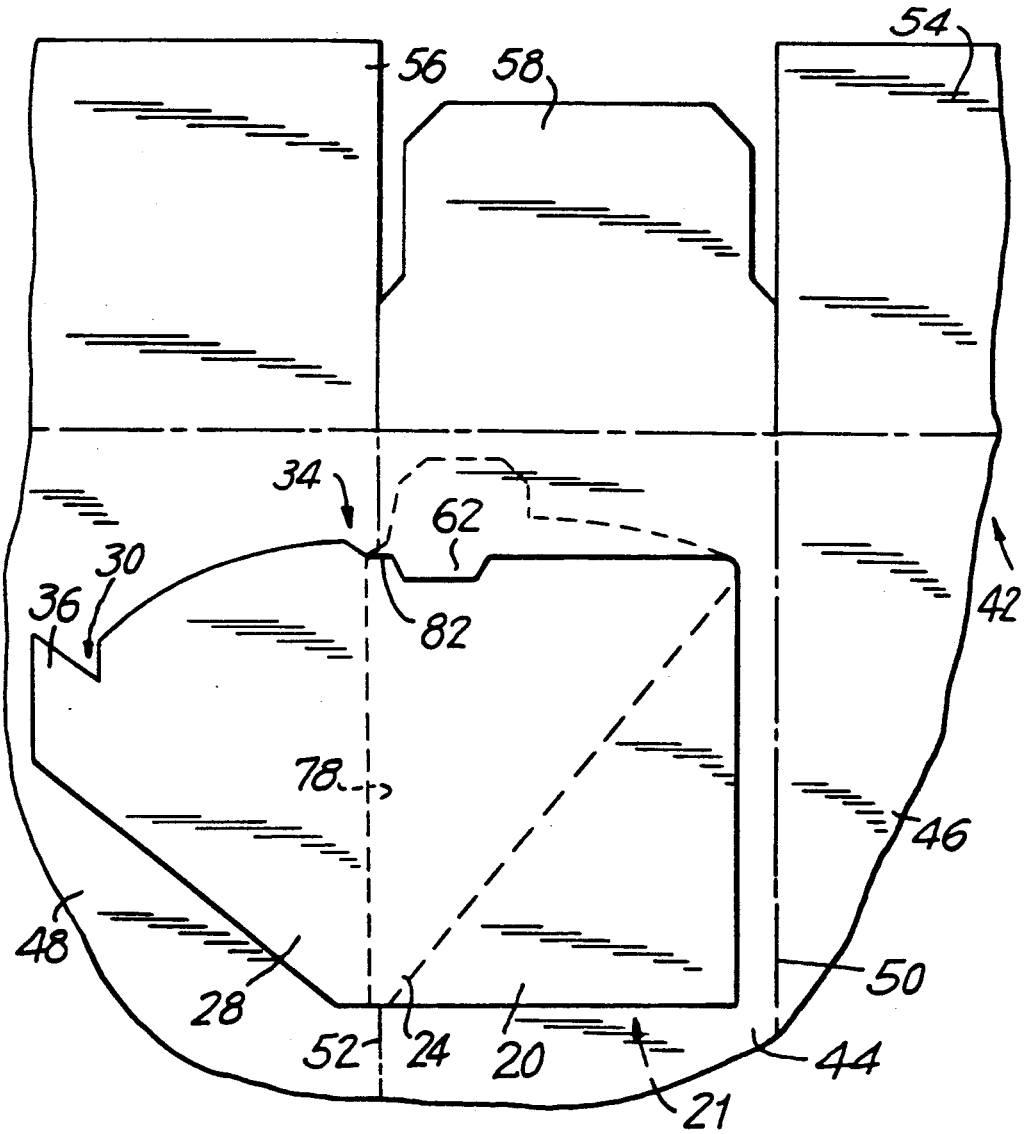
FIG. 2 is an elevational view of the inside of a carton blank having the folding spout of the invention attached.

In general, folding pour spout 21 will be attached to the carton when it is in the form of a flat, essentially two-dimensional carton blank 42, as illustrated in FIG. 2. Attachment of the folding pour spout to the carton blank instead of to an erected or partially erected carton simplifies manufacture. Folding pour spout 21 is attached to the inside of carton blank 42. The carton blank is comprised of paperboard or other suitable material such as a plastic. The paperboard may be inside or outside film laminated, if desired. Carton blank 42 comprises a side panel 44 and two main panels 46 and 48, one of which will constitute a front panel and the other of which will comprise the rear panel, as desired. A second side panel is not shown in FIG. 2. The front and side panels are separated by score lines such as score lines 50 and 52. Adjacent to the tops of the main panels are upper major flaps 54 and 56, whereas lower major flaps 64 and 66 (FIG. 3) are adjacent the bottom of the main panels. The flap attached to the front panel will comprise the outside major flap and the flap attached to the rear panel will constitute the inside major flap. Attached to the top and bottom, respectively of side panel 21 are upper minor flap 58 and lower minor flap 68.

Attachment panel 20 is fastened to the inside of side panel 44 by fastening means such as a glue 70 or hot melt. A generally triangular aperture 60 (FIG. 9) is present in side panel 44. When the mirror image of the spout configuration of FIG. 1 is used, the carton aperture is a mirror image of that used for the carton of FIG. 3. Depending from side panel 44 at the top of the aperture is locking flange 62. First spout-forming panel 24 protrudes through aperture 60 so that pull tab 25 rests against the outer wall of panel 44 and is at least partly prevented from going though the aperture by locking flange 62. Second spout-forming panel 28 rests loosely against main panel 48.

As indicated above, the folding pour spout of the invention can be used in the form shown in FIG. 1, or in its mirror image. FIG. 3 illustrates a carton blank folded into tubular form and including a folding pour spout 21' which is the mirror image of folding pour spout 21. Hereinafter, the mirror image form is illustrated and primed numbers shall designate features corresponding to the mirror image form. Partially erecting the carton blank into tubular form as shown in FIG. 3 is the next step in the fabrication of the carton after gluing attachment panel 20 to the inside of the side panel. Partial erection is accomplished by gluing the glue flap (not shown), which is a narrow strip adjacent one of the main panels, to one of the side panels to form a flattened tube.

During manufacture, it may be necessary to stack the folded tubular form of the carton. Because it is a thin sheet of plastic, the folding pour spout of the invention is used to particular advantage as compared to other recently proposed fitments since it does not add unduly to the thickness of the folded tubular cartons. Thus, balancing means to permit the tubes to stack evenly, such as those proposed by the Gunn patent mentioned above, are not required when the folding spouts of the invention are employed.

Figure 6:
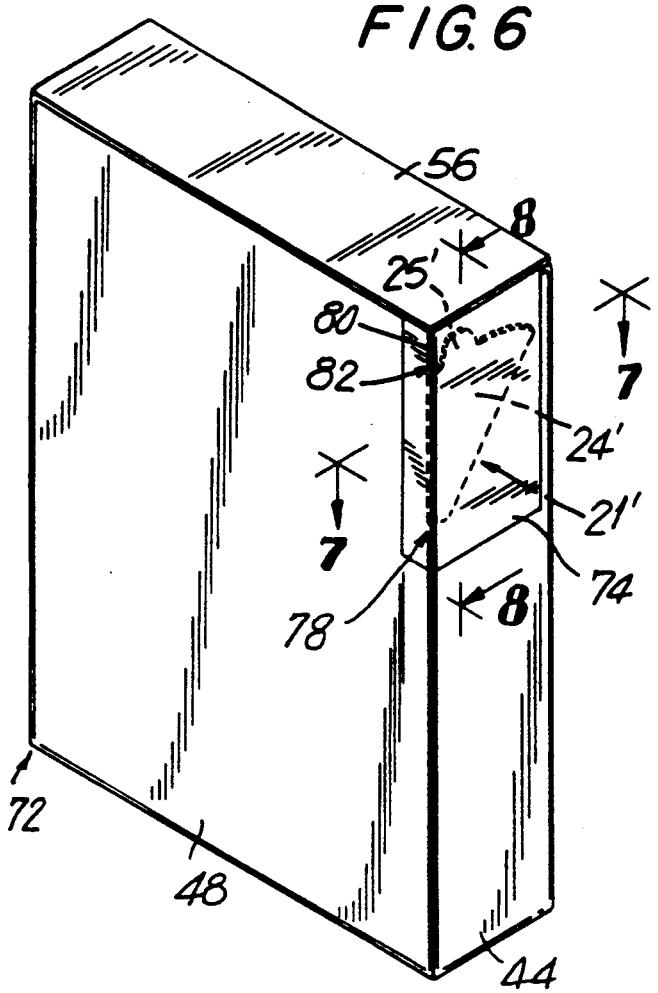
FIG. 6 is a perspective view of an erected carton having the folding pour spout of the invention affixed thereto.
Figure 8:
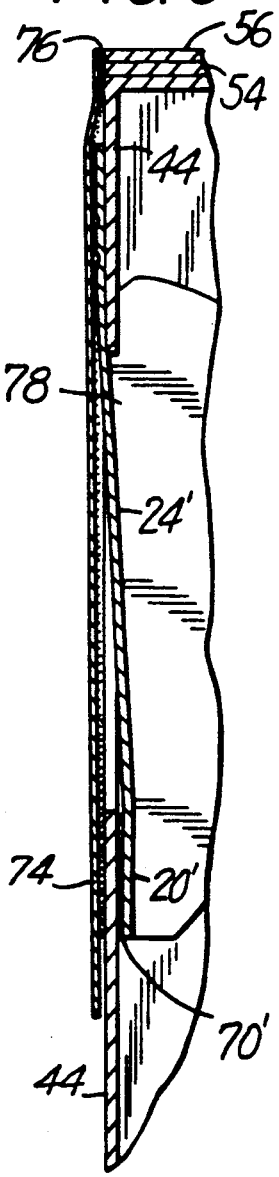
FIG. 8 is a cross section along the line 8—8 of FIG. 6.
Figure 7:
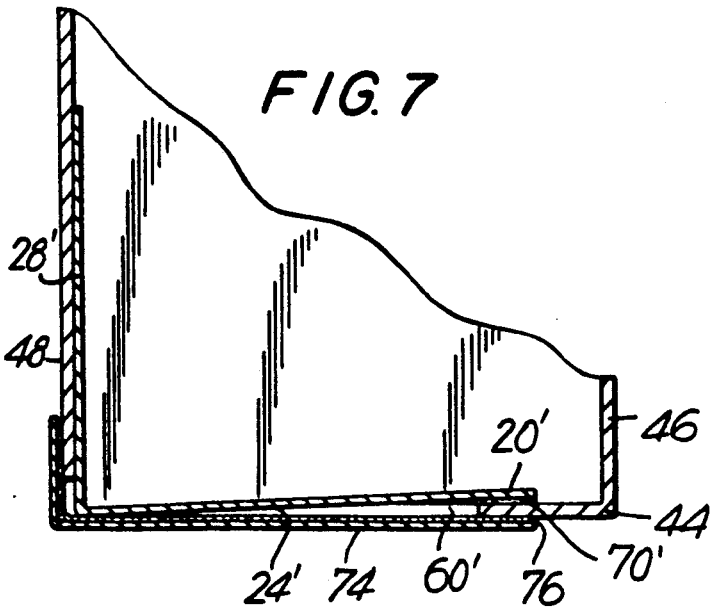
FIG. 7 is a cross section along the line 7—7 of FIG. 6.

The carton is fully erected by folding inwardly the upper and lower minor flaps, the upper and lower inner major flaps and finally the upper and lower outer major flaps. Fully erected carton 72 is shown in FIG. 6. In order to ensure that the carton remains completely sealed during transport, it may be desirable to place a patch 74 over folding pouring spout 21'. Patch 74 may be made of plastic or paper and preferably includes a pre-applied pressure sensitive adhesive layer 76 (FIG. 7) to permit it to cover the folding pour spout temporarily. Patch 74 may extend over to one or more of the major panels, as well, as shown in FIG. 6. It may be desirable to cut away a portion 78 of the corner 80 of the carton to enlarge the aperture and facilitate opening and closing of the spout. A portion of the main panel adjacent the aperture may be cut away for this purpose, as well. Whether or not a patch is used, when the spout is in the sealed position, notch 34 helps keep the spout closed.

Referring particularly to FIGS. 2, 6, 7, 9 and 10, when a consumer wishes to open the carton, he/she will tear away patch 74 to reveal folding pour spout 24'. Grasping pull tab 25', he/she will pull the spout forward. Upon pulling the spout forward, second spout-forming panel 28 slides along the wall of main panel 48. Initially, a certain amount of force must be exerted to pull the spout forward since notch 34 serves to lock the spout in the closed position by abutting wall 82 of corner 80. (See FIGS. 2 and 6) Once notch 34 has been pulled forward, arc-like portion 40 of second spout-forming panel 28 contacts wall 82 of corner 80. The dimensions of arc-like portion 40 are set such that when the spout is pulled forward, arc-like portion 40 abuts tightly corner wall 82. As the spout is pulled further, corner portion 82 reaches notch 30 and stop means 36 which prevents it from proceeding further. Corner wall 82 fits snugly within notch 30 between stop means 36 and notch wall 84 to keep the spout in the open position seen in FIGS. 9, 10 and 11. First and second spout-forming panels 24' and 28' constitute the spout. Unlike many spouts of the prior art, the spout of the invention does not require a flap integral with the carton for attachment.

If desired, a longitudinal notch in corner 80 at 82 may be provided to receive second spout-forming panel and to limit the movement thereof.

When the consumer desires to re-close the container, he/she simply pushes the spout at tab 25 and it returns to the closed position, with corner wall 82 being snugly accommodated within notch 34.

Figure 12:
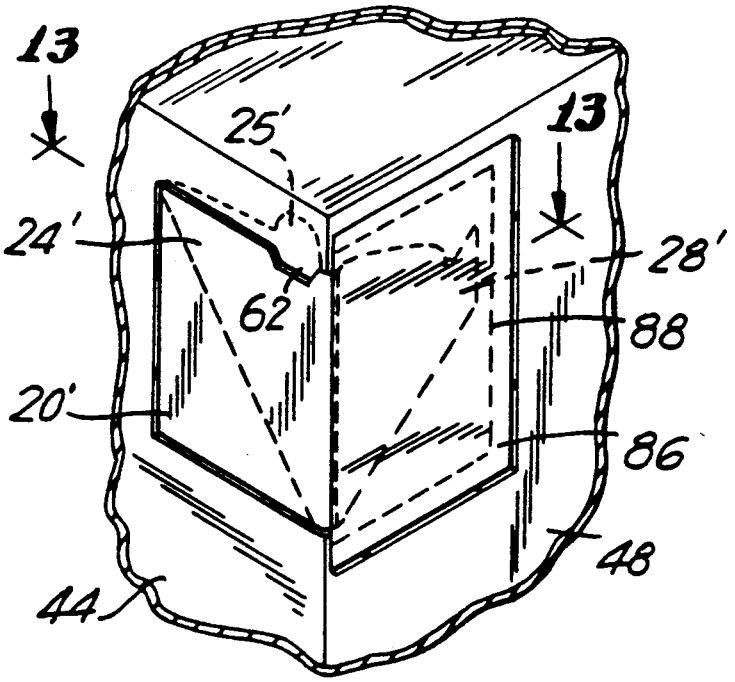
FIG. 12 is a perspective view of an interior corner of a carton having an alternative embodiment of the spout of the invention.
Figure 13:
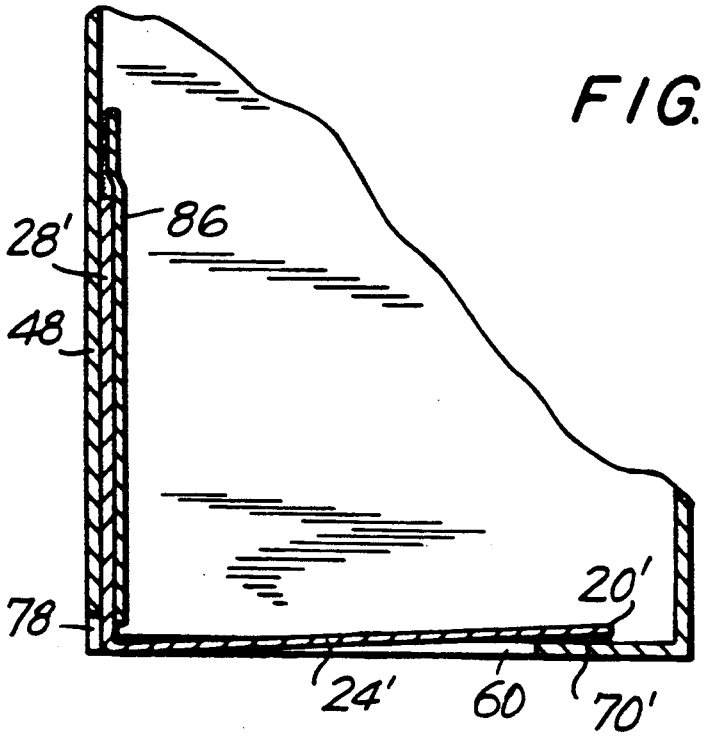
FIG. 13 is a cross section along the line 13—13 of FIG. 12.
Figure 14:
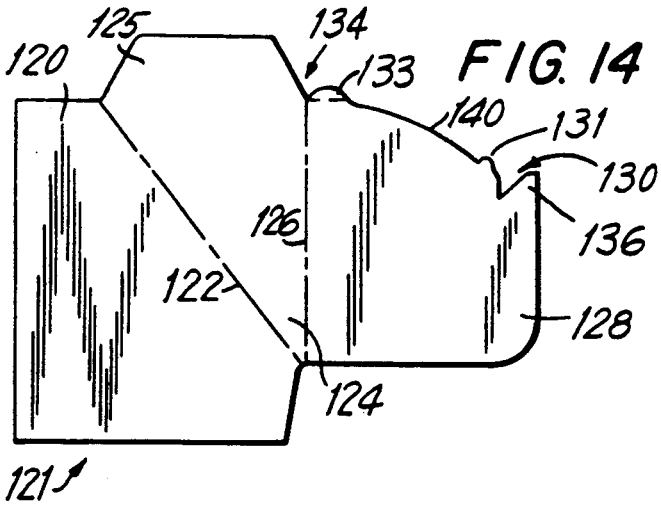
FIG. 14 is a front elevational view of an alternate folding pour spout according to the invention.

In a preferred embodiment, a confining wall is provided to limit the movement of the second spout-forming panel. Referring particularly to FIGS. 12 through 14, panel 48 is provided with second spout-forming panel confining wall 86 disposed parallel and adhering thereto. Adhesive means 88 adhere confining wall 86 to wall 48 on three sides, the fourth being open to accommodate second spout-forming panel 28'. Confining wall 86 limits the movement of second spout-forming panel 28' to a direction essentially parallel to panel 48 and prevents interference by the product held within the carton with the movement of panel 28'.

Figure 15:
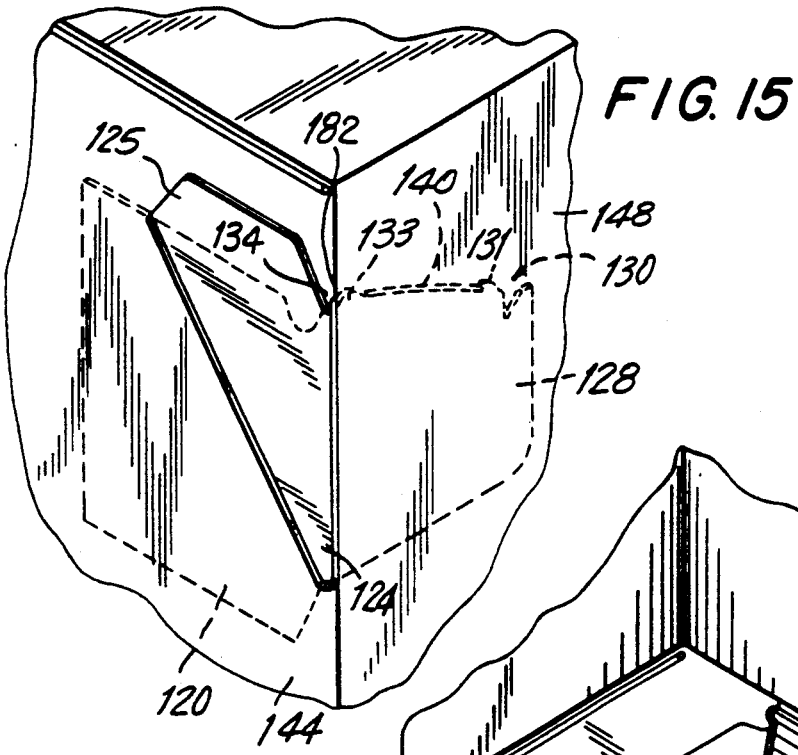
FIG. 15 is a perspective view of an outside corner of a carton having the alternate folding pour spout affixed thereto.
Figure 16:
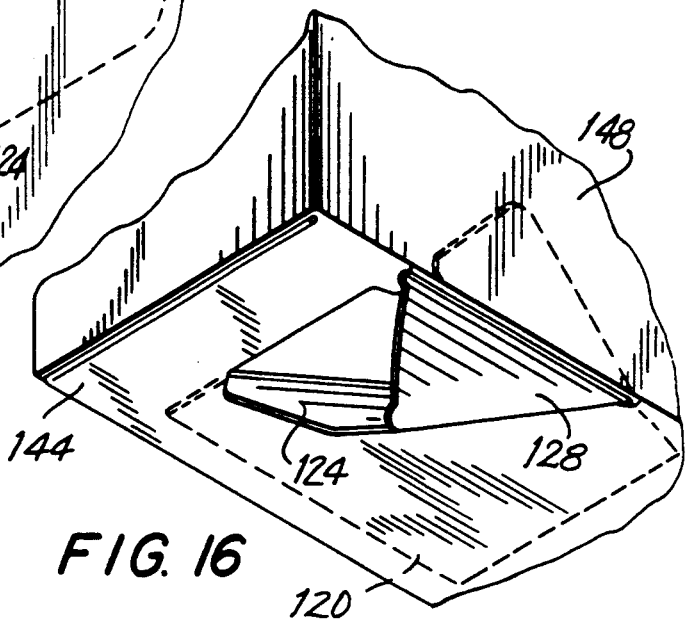
FIG. 16 is a perspective view showing the alternate folding pour spout in pouring position.

A further alternate embodiment is illustrated in FIGS. 15 and 16. The alternate folding pour spout 121 of the invention comprises an attachment panel 120 contiguous with a first spout-forming panel 124 and separated therefrom by a first fold line 122. Attachment panel 120 is adhered to side panel 144. First spout-forming panel 124 generally resembles a sector of a circle. The top of first spout-forming panel 124 projects beyond the top of adjacent panels 120 to form a grasping surface. Also contiguous with first spout-forming panel is second spout-forming panel 128, which is separated from first spout-forming panel 124 by second fold line 126. Second spout-forming panel 128 includes at its upper aspects stop means 136 projecting therefrom, a notch 130, a first ridge 131, an arc-like section 140 and a second ridge 133. Notch 134 is formed between second spout-forming panel 128 and first spout-forming panel 124.

The operation of spout 121 is the same as for spout 21, except that second ridge 133 assists in keeping the spout in the closed position by making it more difficult for corner wall 182 to leave the notch and ridge 131 assists in keeping the spout in the open position by making it more difficult for corner wall 182 to leave notch 130. As can be seen in FIG. 14, ridge 131 is smaller than ridge 133. Main panel 148 may be provided with a confining wall, as previously described in connection with spout 21.

The term "fold lines," as used herein encompasses both perforated lines upon which a fold may be made as well as unperforated fold lines such as score lines.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. An erected carton having an upper periphery, comprising:

(a) a panel including a spout-receiving aperture, said aperture including at least three sides, (b) a non-integral spout blank received within said aperture and comprising an attachment panel, a first spout-forming panel having an upper periphery, said first spout-forming panel being contiguous with said attachment panel, and a second spout-forming panel having an upper periphery, said second spout-forming panel being contiguous with said first spout-forming panel, (c) attachment means attaching at least a portion of said attachment panel to the inside of said carton panel, (d) a first fold line separating said attachment panel from said spout-forming panel, (e) a second fold line separating said first spout-forming panel from said second spout-forming panel, (f) the first and second fold lines forming an angle of less than about 60° and, (g) a confining wall attached to a main panel of said carton and receiving at least a portion of said second spout-forming panel.

* * * * *